US009427058B2

(12) United States Patent
Boglione

(10) Patent No.: US 9,427,058 B2
(45) Date of Patent: Aug. 30, 2016

(54) SUITCASE OR TRAVELLING BAG

(71) Applicant: BasicNet S.p.A., Turin (TO) (IT)

(72) Inventor: Marco Daniele Boglione, Turin (IT)

(73) Assignee: BasicNet S.p.A., Turin (IT)

( * ) Notice: Subject to any disclaimer, the term of this patent is extended or adjusted under 35 U.S.C. 154(b) by 0 days.

(21) Appl. No.: 14/418,706

(22) PCT Filed: Dec. 11, 2012

(86) PCT No.: PCT/IB2012/057184

§ 371 (c)(1),
(2) Date: Jan. 30, 2015

(87) PCT Pub. No.: WO2014/020383

PCT Pub. Date: Feb. 6, 2014

(65) Prior Publication Data

US 2015/0223581 A1 Aug. 13, 2015

(30) Foreign Application Priority Data

Jul. 31, 2012 (IT) ..... TO2012A0680

(51) Int. Cl.
*A45C 5/03* (2006.01)
*A45C 13/00* (2006.01)

(52) U.S. Cl.
CPC ..... *A45C 13/002* (2013.01); *A45C 5/03* (2013.01); *A45C 2005/037* (2013.01)

(58) Field of Classification Search
CPC ..... A45C 13/002; A45C 2005/037
USPC ..... 190/26.102, 109; 150/105
See application file for complete search history.

(56) References Cited

U.S. PATENT DOCUMENTS

| | | | | |
|---|---|---|---|---|
| 2,520,250 | A * | 8/1950 | Meyers | A45C 13/002 190/115 |
| 2,532,154 | A * | 11/1950 | Duskin | A45C 13/002 190/100 |
| 5,439,153 | A * | 8/1995 | Murdoch | A45F 3/02 150/159 |
| 8,152,374 | B2 * | 4/2012 | Shaul | A45C 13/002 150/105 |
| 2003/0116392 | A1 | 6/2003 | Oh | |
| 2003/0141116 | A1 * | 7/2003 | Nuesch | G01G 23/01 177/25.11 |
| 2005/0056511 | A1 * | 3/2005 | Hsieh | A45C 5/045 190/125 |
| 2005/0161482 | A1 * | 7/2005 | Krohn | B62J 9/006 224/413 |
| 2006/0086444 | A1 | 4/2006 | Yu | |
| 2007/0017764 | A1 | 1/2007 | Cheng et al. | |
| 2012/0121210 | A1 | 5/2012 | Meyer et al. | |

OTHER PUBLICATIONS

International Search Report for PCT/IB2012/057184 dated Apr. 3, 2013.

* cited by examiner

*Primary Examiner* — Sue A Weaver
(74) *Attorney, Agent, or Firm* — Heslin Rothenberg Farley & Mesiti P.C.; Victor A. Cardona, Esq.

(57) ABSTRACT

A suitcase or travelling bag includes a casing that may be opened and closed, and which has a receptacle accessible from outside and housed within which is an extractable protective sheet designed to form a protective covering of the casing.

3 Claims, 4 Drawing Sheets

FIG. 1
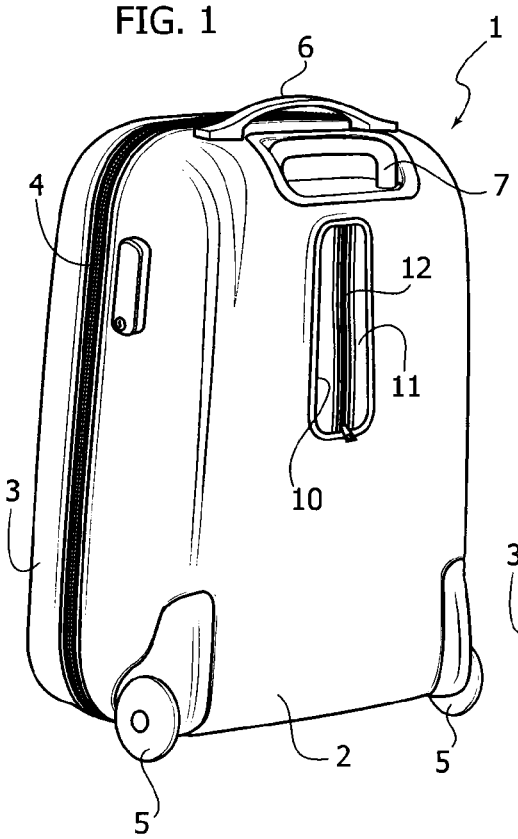
FIG. 2
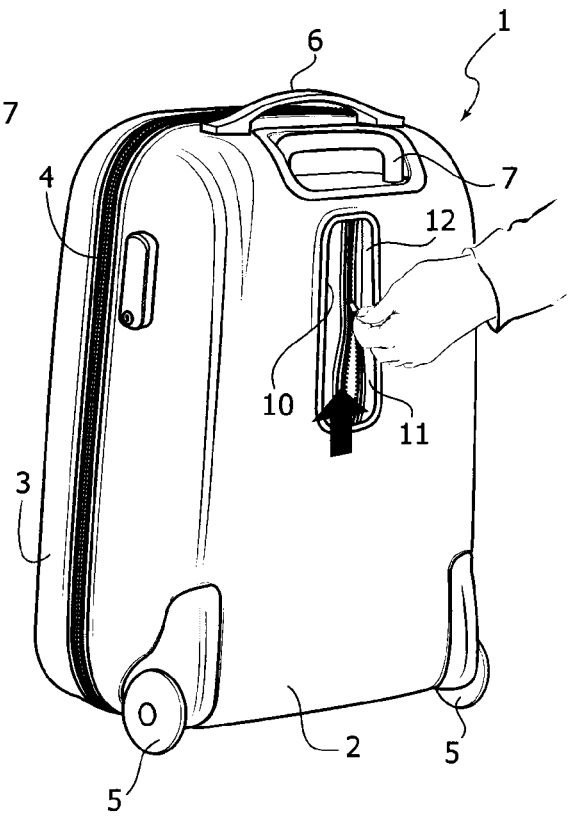
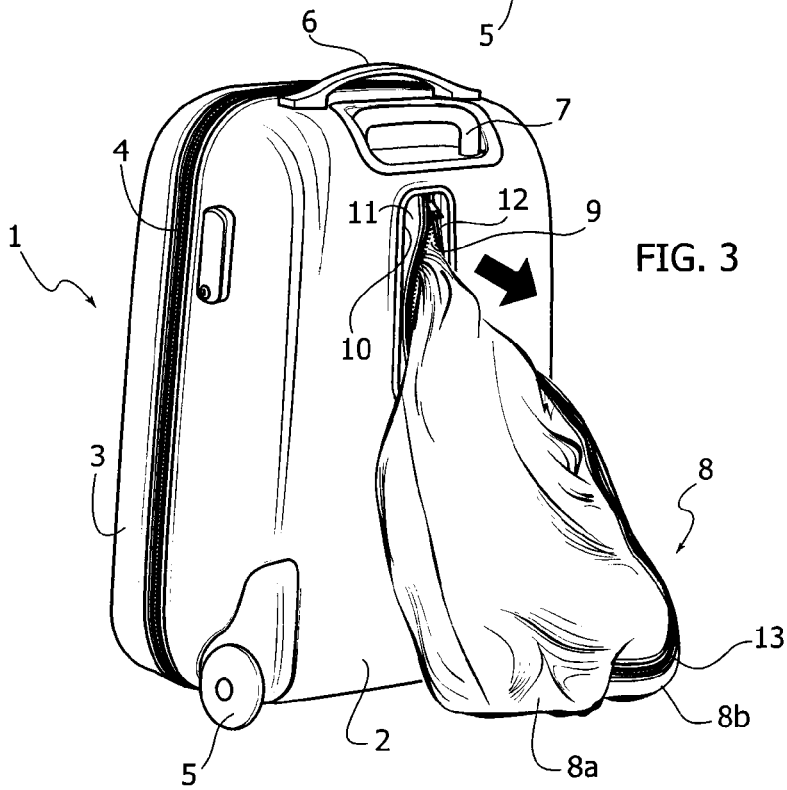
FIG. 3

SUITCASE OR TRAVELLING BAG

CROSS REFERENCE TO RELATED APPLICATIONS

This application is a National Stage of PCT International Application No. PCT/IB2012/057184, filed on Dec. 11, 2012, and published in English on Feb. 6, 2014 as WO 2014/020383 A1, which claims priority from Italian Patent Application No. TO 2012 A 000680 filed on Jul. 31, 2012, the entire disclosures of which are incorporated herein by reference.

FIELD OF THE INVENTION

The present invention relates to suitcases or travelling bags comprising a casing that can be opened and closed, for example formed by two generally rigid half-shells articulated together along one side and connected by a zip along the other sides.

SUMMARY OF THE INVENTION

The technical problem underlying the present invention is to protect the casing of suitcases or bags of this sort both against poor weather conditions and against risks of surface damage during manipulation of the suitcase or bag particularly in the context of services of collective transport (aeroplanes, trains, buses, etc.).

According to the invention, said problem is solved thanks to the fact that the casing of the suitcase or travelling bag has a receptacle accessible from outside, housed within which is an extractable protective sheet designed to form a protective covering of the casing.

The receptacle for the protective sheet is conveniently contained within the overall dimensions of the suitcase or travelling bag and is advantageously set inside the casing.

In a preferred embodiment of the invention, in which the casing is formed by two rigid or semi-rigid half-shells, the receptacle for the protective sheet is delimited by an opening of one of the two half-shells and consists of a pocket normally closed by a zip accessible through said opening.

In order to facilitate application on the casing of the suitcase or travelling bag, the protective sheet is advantageously formed by two half-parts, which may be connected together via a zip.

In addition, the protective sheet is conveniently made of an impermeable and relatively thin material.

BRIEF DESCRIPTION OF THE DRAWINGS

Further characteristics and advantages of the invention will emerge clearly from the ensuing detailed description, with reference to the annexed drawings, which are provided purely by way of non-limiting example and in which:

FIG. 1 is a schematic perspective view that shows an example of embodiment of the suitcase according to the invention; and FIGS. 2 to 9 are views similar to FIG. 1 that show the successive steps of application of the protective sheet with which the suitcase is equipped.

DETAILED DESCRIPTION OF THE INVENTION

Figure 4:
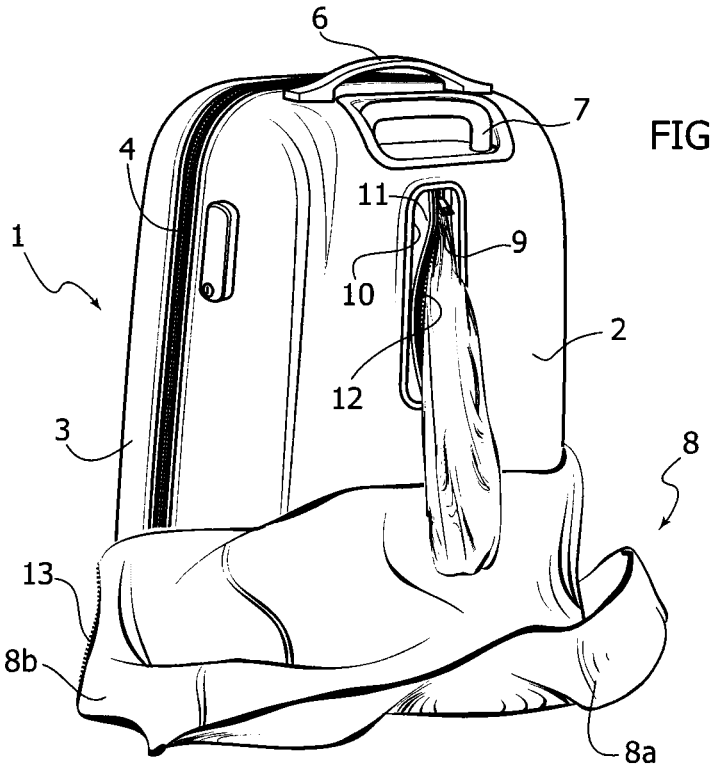
Figure 5:
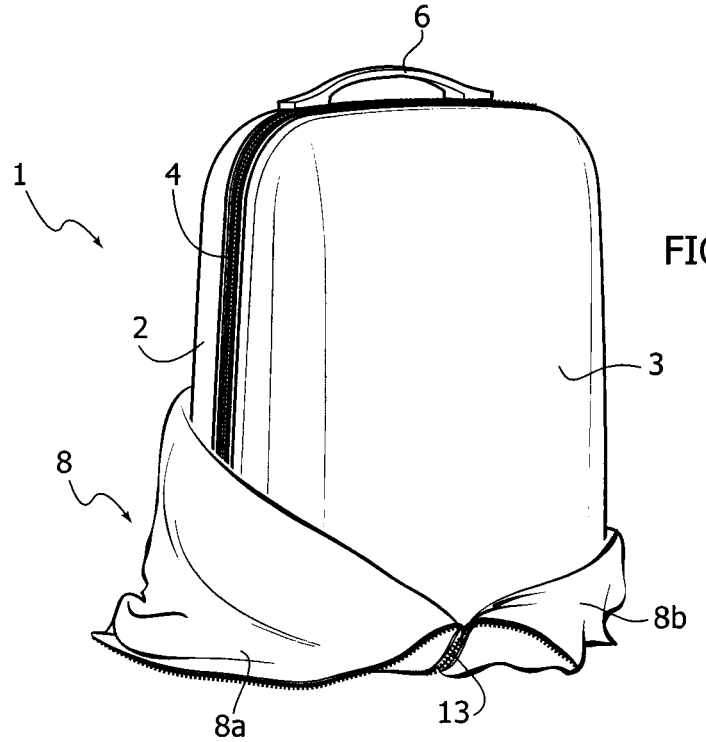
Figure 6:
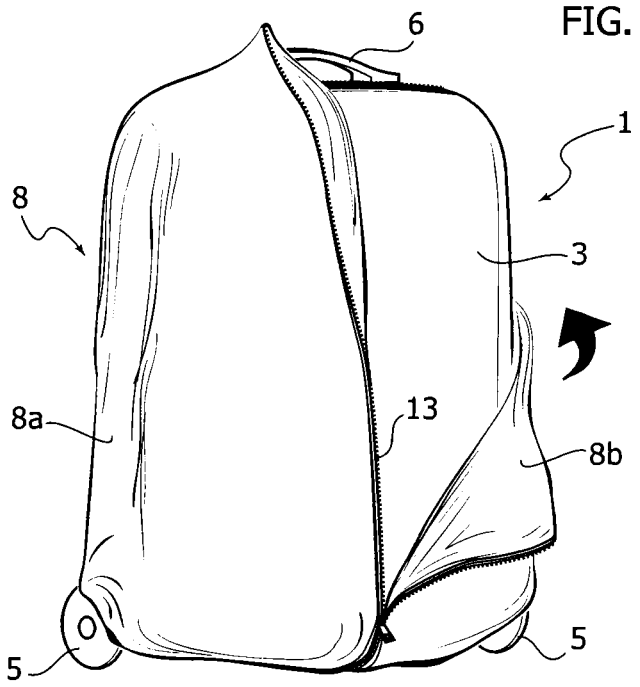
Figure 7:
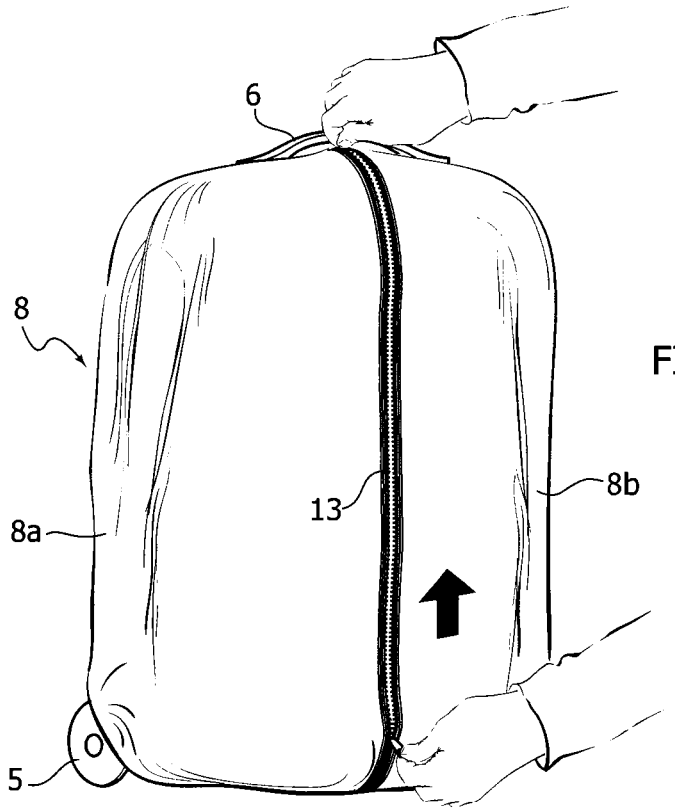
Figure 8:
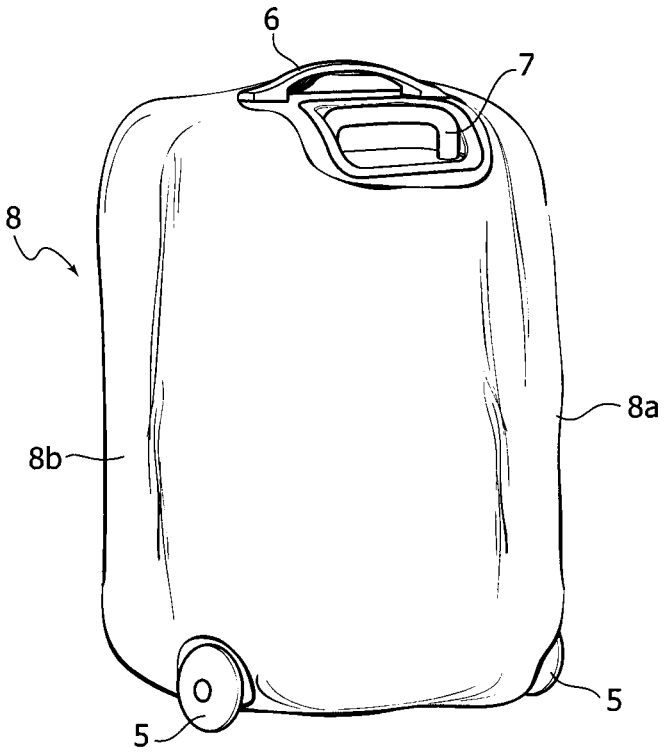
Figure 9:
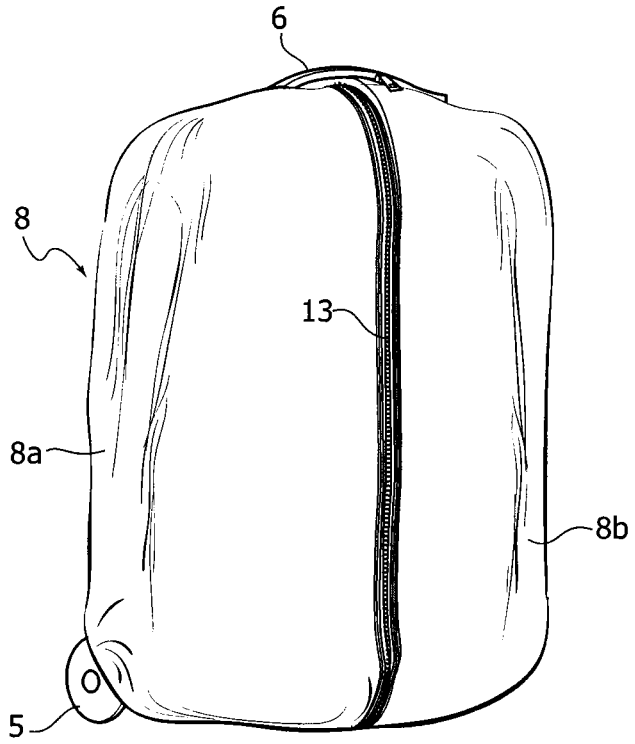

In the case of the example illustrated, the invention is applied to a suitcase of the trolley type, constituted, in a generally conventional way, by a casing 1 formed by two rigid or semi-rigid half-shells 2, 3 articulated together along one side in such a way that it can be opened and closed via a zip 4 that extends along the other three sides. It should, however, be noted that the invention is applicable to suitcases or travelling bags of any type, size and shape, even with a non-rigid structure.

To return to the example illustrated, the casing 1 is provided at the bottom with wheels 5 (in the case of the example illustrated two, but even possibly four swivel wheels), and at the top with a fixed handle 6 as well as with a telescopically extractable grip 7 for pulling the suitcase so that that it can be rolled along on the wheels 5.

According to the peculiar characteristic of the invention, the suitcase is equipped with a protective sheet 8 (FIGS. 3 to 9) designed to form a protective covering of the casing 1.

The protective sheet 8 is normally housed in folded or rolled-up condition inside a receptacle 9 (FIGS. 2 to 4) provided within the overall dimensions of the casing 1 and conveniently prearranged therein.

In the case of the example illustrated, the receptacle 9 is formed by a pocket defined by the space comprised between the internal surface of the half-shell 2 and a flexible internal coating (not visible in the drawings) with which the casing 1 is normally equipped, and is accessible through an opening 10 of said half-shell 2.

The opening 10 is elongated vertically and extends underneath the grip 7: set along said opening 10 is a protection 11, normally flexible and applied to the internal surface of the half-shell 2, which can be opened and closed via a zip 12 accessible through the opening 10.

By opening the zip 12, in the way represented in FIG. 2, the receptacle 9 can be accessed from outside in such a way as to enable extraction and unfolding of the protective sheet 8, in the way represented in FIGS. 3 and 4.

For ease of application, the protective sheet 8 is conveniently formed by two half-parts 8*a*, 8*b* (FIGS. 5 to 7 and 9) connected together via a zip 13.

The modalities of application of the protective sheet 8 on the casing 1 of the suitcase are highlighted in FIGS. 5 to 9: after completely covering the casing 1, the two half-parts 8*a*, 8*b* are re-closed using the zip 13, thus making available a complete protective covering close-fitting to the casing 1 in such a way as to protect it effectively not only against poor weather conditions (and for this purpose the sheet 8 will be conveniently made of a thin waterproof material), but also against risks of surface damage due to impact and rubbing of said casing 1 during transportation and manipulation of the suitcase.

Obviously, the protective sheet 8 will be provided with openings for the handle 6, the extractable grip 7, and the wheels 5.

Of course, the details of construction and the embodiments may vary widely with respect to what has been described and illustrated herein, without thereby departing from the scope of the present invention, as defined in the ensuing claims.

The invention claimed is:

1. A suitcase or travelling bag comprising: a casing that can be opened and closed, the casing comprising:

a receptacle set inside the casing and accessible from outside;

an extractable protective sheet within said receptacle and designed to form a protective covering of the casing;

the casing formed by two generally rigid half-shells and said receptacle delimited by an opening of one of said half-shells consisting of a pocket normally closed by a zipper accessible through said opening and applied to a flexible protection of said opening; and said protective sheet is formed by two half-parts that can be connected via a zipper, said protective sheet, in the applied condition, is close-fitting to said casing, and said protective sheet made of an impermeable material.

2. The suitcase or travelling bag according to claim 1, wherein said receptacle is contained within the overall dimensions of the casing.

3. The suitcase or travelling bag according to claim 2, wherein said receptacle is set inside the casing.

* * * * *